US006128913A

United States Patent [19]

Dell'Acqua

[11] Patent Number: 6,128,913

[45] Date of Patent: Oct. 10, 2000

[54] DEVICE FOR THE COOLING OF TEXTURIZED YARNS AND TEXTURIZING APPARATUS FITTED WITH SAID DEVICE

[75] Inventor: Silvano Dell'Acqua, Gorla Maggiore, Italy

[73] Assignee: Plantex S.p.A. Viale Europa, Gorla Maggiore, Italy

[21] Appl. No.: 09/262,071

[22] Filed: Mar. 4, 1999

[30] Foreign Application Priority Data

Jun. 22, 1998 [IT] Italy ..... MI98A1423

[51] Int. Cl.[7] ..... F25D 25/02; D02G 1/00; F28D 11/02

[52] U.S. Cl. ..... 62/381; 28/248; 165/50

[58] Field of Search ..... 62/378, 381, 62, 62/63; 28/241, 248, 249; 57/350, 403, 415; 165/89, 90

[56] References Cited

U.S. PATENT DOCUMENTS

| | | | |
|---|---|---|---|
| 2,599,346 | 6/1952 | Offen | 165/89 |
| 2,797,899 | 7/1957 | Funk et al. | 165/90 |
| 3,481,012 | 12/1969 | Saxon . | |
| 3,626,480 | 12/1971 | Takel et al. | 165/61 |
| 4,526,533 | 7/1985 | Pabst | 432/4 |
| 4,620,345 | 11/1986 | Fleissner . | |
| 4,646,540 | 3/1987 | Blackwood et al. | 62/373 |
| 5,174,206 | 12/1992 | Molinatto | 101/216 |

FOREIGN PATENT DOCUMENTS

| | | |
|---|---|---|
| 0 164 912 | 12/1985 | European Pat. Off. . |
| 196 13 177 | 10/1996 | Germany . |
| 1225143 | 3/1971 | United Kingdom . |

*Primary Examiner*—William Doerrler
*Attorney, Agent, or Firm*—Young & Thompson

[57] ABSTRACT

A cooling device for texturized yarns comprises a rotating drum equipped with a perforated wall, a unit capable of depositing the yarn exiting from a texturizing nozzle on the perforated surface, and a device capable of aspirating air from the inside of the drum, and elements are provided capable of circulating a refrigerating fluid inside the drum as well as elements, external, with respect to the drum, adapted to cool the air that is aspirated through the holes of the drum to cool the yarns.

6 Claims, 3 Drawing Sheets

DEVICE FOR THE COOLING OF TEXTURIZED YARNS AND TEXTURIZING APPARATUS FITTED WITH SAID DEVICE

FIELD OF THE INVENTION

This invention relates to a device for the cooling of texturized yarns, as well as a texturizing apparatus fitted with such a device, of a type comprising a rotating drum with a perforated wall, on which the texturized yarn to be cooled is deposited.

SUMMARY OF THE INVENTION

The device includes a diffuser partially following the profile of the drum and passing cold air at a controlled temperature, aspirated from inside the drum. A further feature of the invention is that it provides for a hollow drum, partially or totally filled with a refrigerating fluid circulated through an inlet conduit essentially coinciding with the axis of the drum and exiting through a conduit coaxial with the former.

This leads to a better efficiency of the drum cooling system and consequently of the texturized yarn deposited on the same, with the resulting considerable advantages of a practical nature described below.

As known, the synthetic yarns are subjected to a so-called voluminizing and texturizing process designed to lend the flosses constituting the yarn a permanently wavy condition that allows achieving more voluminous and elastic fibers with an enhanced covering ability.

For this purpose, the flosses with a parallel shape (flat yarns) following the drawing out operation are fed to a container where they accumulate, and as a result of hot air and vapor injected to the container under pressure in a direction concurrent with the flosses bend upon themselves in a random manner at the proper temperature conditions.

At the outlet of the texturizing nozzle the filaments are cooled, so as to permanently set the deformation applied to them.

The invention refers to an improved cooling device utilized for this purpose. At the present state of the art, various cooling devices are known which include means capable of drawing air from the environment and transversally directing it over the multiple types of texturized filaments composing the yarn, while resting the filaments on a support formed by a perforated surface.

The air is blown against the yarn over a length of its path which depends on the velocity of the yarn exiting the texturizer, and the temperature difference needed to lend the deformations imposed on the flosses a permanent form. A further parameter affecting the efficiency of the equipment is the temperature of the cooling air and of the equipment in contact with the yarn. This equipment tends to heat up under the effect of the heat transmitted by the yarn as well as by the cross-flow of air.

A first known cooling device is shown in a simplified form in the views along orthogonal planes provided in the FIGS. 1 and 2.

This system is formed by a drum 1 whose perforated external wall acts to support the yarn exiting from a texturizing equipment 2.

Certain devices of a known type, not shown here but connected to a sleeve 3 coaxial with the drum aspirate the air through the perforated surface.

The aspiration usually occurs opposite one of the sectors of the drum's surface, a sector indicated by the number 4, whose width is determined depending on the type of filament and the other parameters mentioned above.

Another known cooling device shown in the FIGS. 3 and 4 comprises a perforated moving belt 6, on which the texturized yarn exiting the device 2 is supported.

The cooling air blown directly across the yarn is aspirated through a channel 7 by a blower, not shown in the figure.

The length of the cooling interval is adjusted, depending on the various parameters, by changing the position of a mobile dividing partition 8. However, these known systems suffer from a drawback caused by the poor efficiency, among other things, of the fairly high temperatures attained by the yarn supports when the equipment is under full operating conditions, due to the heat absorbed by the latter from the hot yarn resting on the same and by the cross-flowing air.

A further drawback is caused by the difficulty of obtaining constant results, which is also due to the variability of the environmental air used to cool the yarn.

In order to solve the mentioned drawbacks, this invention proposes a cooling device for texturized yarns of a rotating drum type, which provides means capable of circulating a certain volume of refrigerating fluid inside the drum, in particular of water and other media capable of cooling the ambient air aspirated through the drum's perforated surface, so as to bring it to a more suitable temperature for the process, allowing the system to attain better efficiency and maintain constant operating parameters, thus ensuring more uniform results.

These means allow achieving a thermal shock on the product, so as to cause a permanent fixation of the voluminizing treatment incapable of being altered and thus losing efficiency during the subsequent textile treatments of the yarn.

BRIEF DESCRIPTION OF THE DRAWINGS

This invention will now be described in detail, for exemplifying but non-limiting purposes, with reference to the accompanying figures in which.

DETAILED DESCRIPTION OF THE INVENTION

Figure 2:
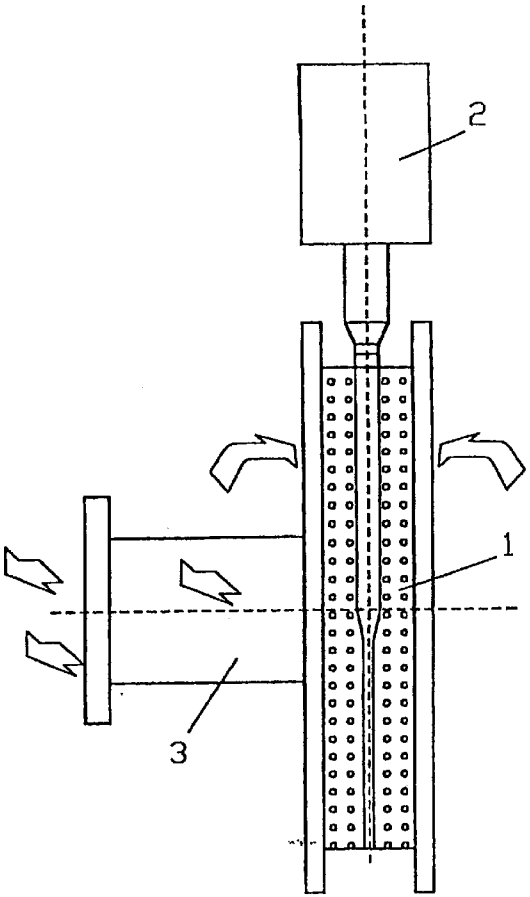
Fig. 2 PRIOR ART
FIGS. 1 and 2 depict a first known cooling device in a simplified form.
Figure 1:
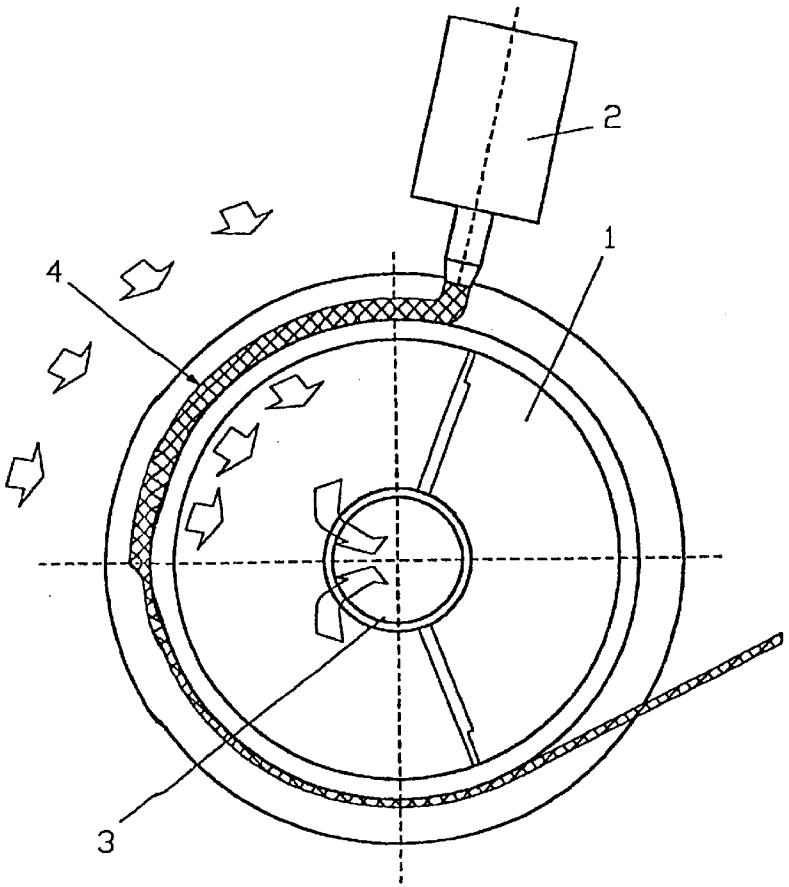
Fig. 1 PRIOR ART
Figure 3:
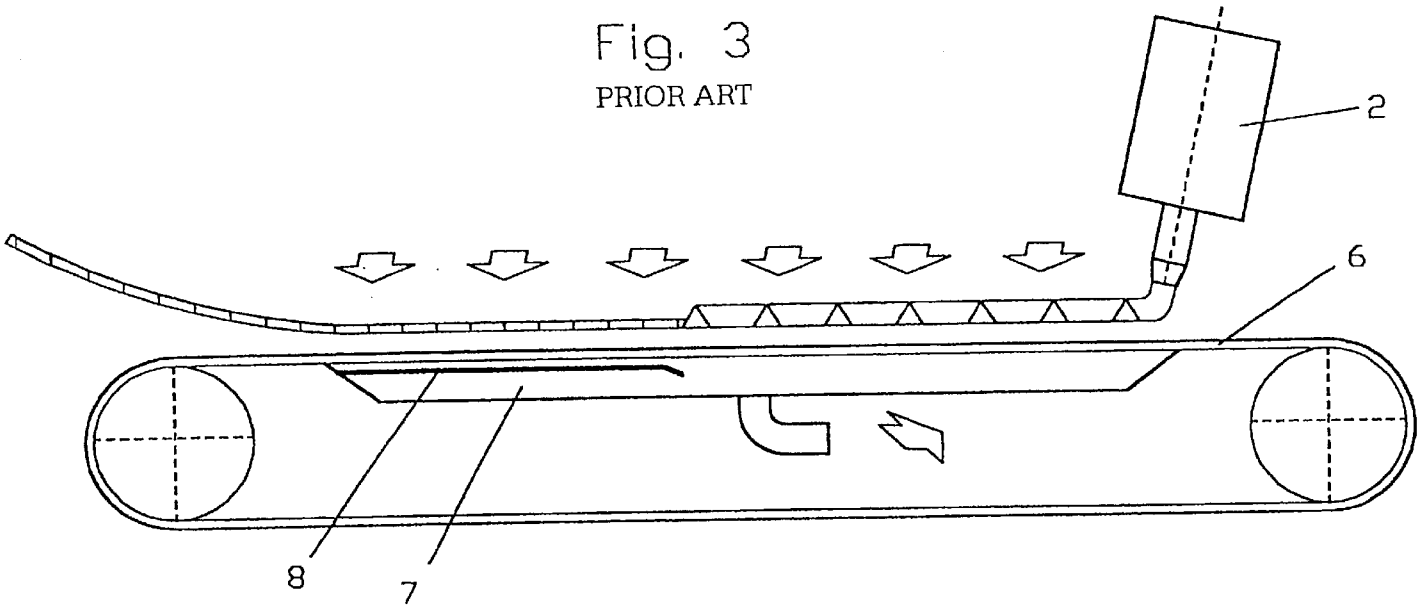
Fig. 3 PRIOR ART
FIGS. 3 and 4 depict another known cooling device with a perforated moving belt for supporting exiting texturized yarn.
Figure 4:
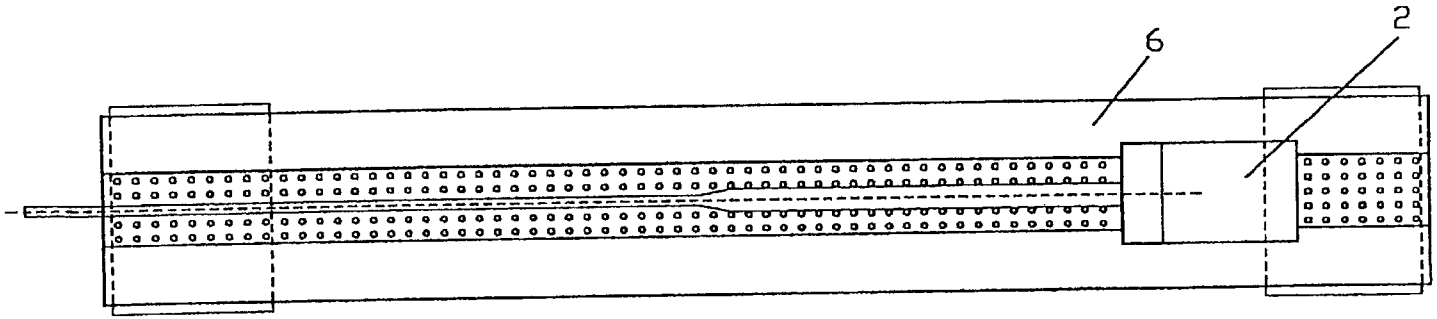
Fig. 4 PRIOR ART
Figure 6:
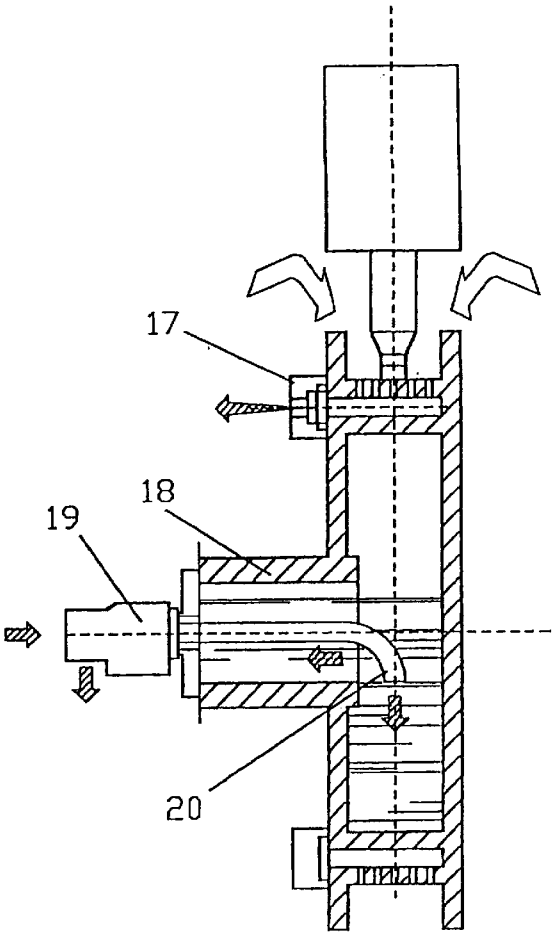
FIG. 6 is a cross-section of the same device taken along a plane orthogonal to that of the previous figure.
Figure 5:
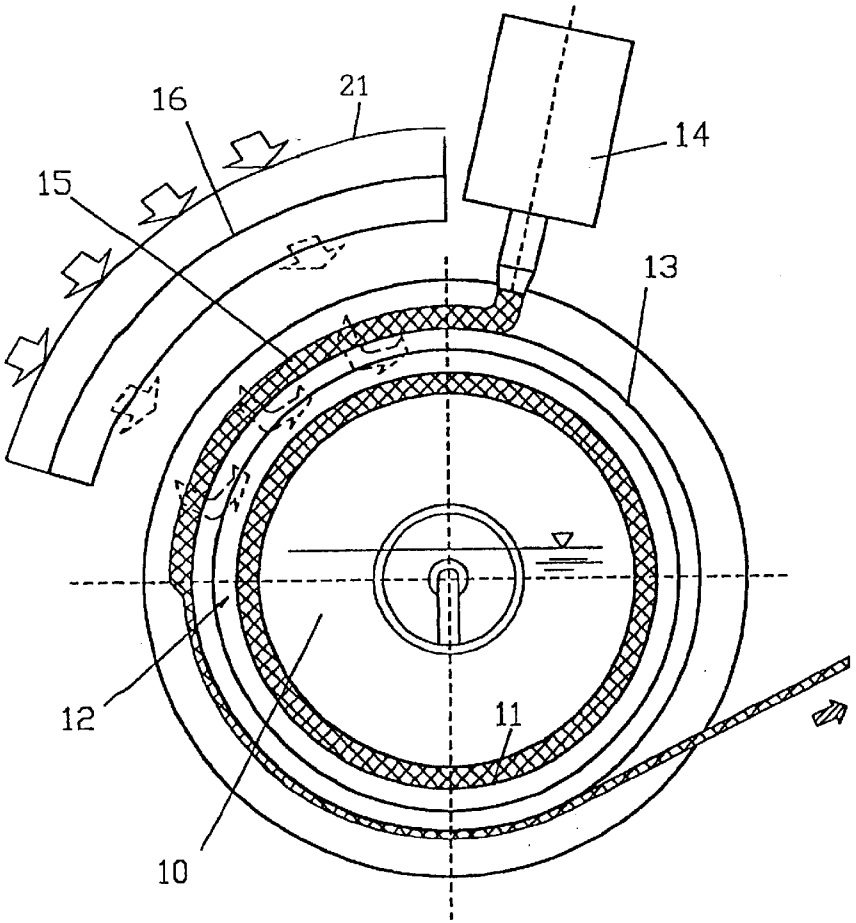
FIG. 5 is a view of a cooling device according to the invention.

With reference to FIGS. 5 and 6, the cooling device according to the invention comprises a rotating drum shown in its overall form by 10, inside which a partition 11 generates an annular space 12 running along the inside of the perforated wall 13 on which the texturizing nozzle deposits the yarns. The latter are indicated by the number 15.

A diffuser 16 connected to an air cooling device 21 and arranged opposite one of the sectors of the drum passes refrigerated air which is directed against the yarns 15 and then aspirated through a row of lateral orifices 17 (FIG. 6) connected to aspirating devices of a known type, not shown in the figure.

The drum is firmly attached to a hub 18 which is coaxial with the drum itself and also capable of acting as a support.

A tube 20, connected to a rotating joint 19 and coaxial with the drum, penetrates inside the drum through the hub 18 and discharges a certain volume of refrigerated water originating from a refrigerating device of a known type, not shown in the figure.

The water then exits through the hub 18 and returns to the recirculating system.

The operation is as follows.

First, the operating parameters are established based on the type of yarn, by setting up an adequate temperature for the cooling water circulating inside the drum, and the temperature circulating in the air circulating sector.

The width of the cooling sector is then eventually adjusted, for instance by regulating a partition (not shown in the figure) on the diffuser 16.

The machine is started at this point.

The yarns coming from the texturizer 14 are deposited on the perforated surface of the drum, which is maintained at a constant rotating speed.

The refrigerated air coming from the diffuser crosses the yarns and is aspirated through the perforations of the drum wall, to be laterally discharged through the nozzle 17.

At the same time, a certain volume of water is introduced inside the drum through the tube 20, so as to exit through the hub 18 and is maintained in circulation after being returned to the desired temperature.

Under these conditions the yarn resting on the drum encounters a temperature lower than that in the known systems, and undergoes a greater thermal shock.

This consequently achieves a high degree of efficiency, while improving the texturizing conditions with respect to those applied in the known types of equipment.

Certain variants may then be envisioned, while keeping within the same scope of the invention.

For example, certain means may be provided to approach or detach the diffuser from the surface of the drum, or different systems may be provided to ensure the circulation of the refrigerating fluid within the drum.

A specialist in the trade may further envision numerous other changes or variants, all of which are however to be deemed to fall within the scope of this invention.

What is claimed is:

1. A cooling device for texturized yarns comprising a rotating drum equipped with a perforated wall;

means capable of depositing the yarn exiting from a texturizing nozzle on an outer surface of said perforated wall;

means capable of directing cooled air against the wall of the drum;

means capable of aspirating air from inside the drum; and means capable of circulating a refrigerating fluid inside the drum.

2. The cooling device according to claim 1, further comprising outside said drum, some means capable of refrigerating the air aspirated through the perforations of the perforated wall of the drum designed to cool the yarns.

3. The cooling device according to claim 1, wherein the drum has a fluid impervious wall defining an annular space inside the perforated wall, and the means capable of circulating a refrigerating fluid comprise a conduit connected to refrigerating devices, capable of maintaining a refrigerated liquid inside said drum.

4. The cooling device according to claim 3, wherein the refrigerating liquid is introduced and picked up through two conduits coaxial with the axis of the drum.

5. The cooling device according to claim 1, wherein the means capable of directing cooled air against the wall of the drum comprise a diffuser partially surrounding said drum and connected to air cooling devices.

6. The cooling device according to claim 2, wherein the drum has a fluid impervious wall defining an annular space inside the perforated wall, and the means capable of circulating a refrigerating fluid comprise a conduit connected to refrigerating devices, capable of maintaining a refrigerated liquid inside said drum.

* * * * *